US006312803B1

(12) United States Patent
Mendis

(10) Patent No.: US 6,312,803 B1
(45) Date of Patent: Nov. 6, 2001

(54) PROCESS OF MANUFACTURING FROM NATURAL FIBER A DOOR CLOSER AND STOPPER WHICH ALSO SERVES AS A SCRAPPER, WIPER OR MAT

(75) Inventor: Hilarian Chrishan Salinda Mendis, Ratmalana (LK)

(73) Assignee: Rileys Limited (LK)

( * ) Notice: Subject to any disclaimer, the term of this patent is extended or adjusted under 35 U.S.C. 154(b) by 0 days.

(21) Appl. No.: 09/124,870

(22) Filed: Jul. 30, 1998

(51) Int. Cl.[7] ..... D02D 3/00

(52) U.S. Cl. ..... 428/364; 428/15; 428/82; 428/91

(58) Field of Search ..... 428/16, 82, 91, 428/192, 193, 364, 15; D8/402; D21/603; 446/369, 370; 29/428, 433, 419.1, 403.2; 300/21

(56) References Cited

U.S. PATENT DOCUMENTS

| | | | | |
|---|---|---|---|---|
| D. 369,887 | | 5/1996 | Mendis | D32/47 |
| D. 387,525 | | 12/1997 | Fernando | D32/47 |
| D. 398,112 | | 9/1998 | Mendis | D32/47 |
| 3,425,085 | * | 2/1969 | Moss | 15/229 |
| 5,133,590 | * | 7/1992 | Fitjer | 300/21 |

FOREIGN PATENT DOCUMENTS

| | | | |
|---|---|---|---|
| 2335397 | * | 1/1975 | (DE) . |
| 19715150A1 | * | 10/1997 | (DE) . |
| 818174A2 | * | 1/1998 | (EP) . |
| 2233554A | * | 1/1991 | (GB) . |
| 5/209309 | * | 8/1993 | (JP) . |
| 7-109652 | * | 4/1995 | (JP) . |
| 8-280561 | * | 10/1996 | (JP) . |

OTHER PUBLICATIONS

U.S. application No. 29/096,030, Fernando, filed Nov. 3, 1998.
U.S. application No. 29/096,031, Fernando, filed Nov. 3, 1998.
U.S. application No. 29/096,032, Fernando, filed Nov. 3, 1998.
U.S. application No. 29/096,033, Fernando, filed Nov. 3, 1998.
U.S. application No. 29/096,034, Fernando, filed Nov. 3, 1998.
U.S. application No. 29/097,268, Mendis, filed Dec. 2, 1998.
U.S. application No. 29/099,476, Fernando, filed Jan 22, 1999.
U.S. application No. 29/099,501, Fernando, filed Jan. 22, 1999.
U.S. application No. 29/099,502, Fernando, filed Jan. 22, 1999.
U.S. application No. 29/099,503, Fernando, filed Jan. 22, 1999.
U.S. application No. 29/099,504, Fernando, filed Jan. 22, 1999.
U.S. application No. 29/099,505, Fernando, filed Jan. 22, 1999.
U.S. application No. 29/099,506, Mendis, filed Jan. 22, 1999.

* cited by examiner

*Primary Examiner*—Deborah Jones
*Assistant Examiner*—Abraham Bahta

(57) ABSTRACT

A combination door stopper and mat is made with natural fibre twisted into fiber rods, and with pads and binding wire. The components are tied with binding wire to take the shape of a turtle having a shell and a belly, legs, head, tail and anti-skid pads or any other animal or inanimate object.

10 Claims, 2 Drawing Sheets

PROCESS OF MANUFACTURING FROM NATURAL FIBER A DOOR CLOSER AND STOPPER WHICH ALSO SERVES AS A SCRAPPER, WIPER OR MAT

BACKGROUND OF THE INVENTION

1. Field of the Invention

The present invention relates to a dual purpose apparatus and the method of making it, and more specifically to a door stopper and closer that also functions as a wiper, scraper or mat.

2. Description of the Prior Art

Conventional door closers and stoppers are typically made of metal—not from natural products, and they cannot be used for a second purpose such as wiping or scraping which is a necessity near doors in certain parts of the world. In such parts of the world where the climate is cold or dusty it is necessary to have a door closer and stopper for the door to be kept closed most of the time to keep away the cold air or dust from entering a buildings. It is also necessary to have a wiper near the door to wipe the bottoms of boots or shoes of the people entering the buildings, as these boots and shoes usually will be covered with snow, dust or dirt.

Therefore, the present invention provides a novel, dual purpose item (made mainly of natural fibre) that can be used both as a door closer or stopper and as a wiper, scraper, or mat. Such an item has not been introduced in the past, and the prior art is confined to individual items such as conventional wipers and door closers or stoppers. These conventional items are made of metal which tends to corrode when exposed to the elements. Metal components also tend to wear away in dusty atmospheres.

SUMMARY OF THE INVENTION

Thus, an object of the present invention is to overcome the above disadvantages encountered while using the conventional wipers and door closers or stoppers.

In accordance with one embodiment of the present invention, a door closer and stopper which also serves as a wiper, scraper or mat includes natural fibre twisted into fibre rods on galvanized wire, rubber pads and binding wire. These components are tied with binding wire to form the shape of a turtle or other animal or inanimate object.

BRIEF DESCRIPTION OF THE DRAWINGS

For a more complete understanding of this invention, one should now refer to the embodiment illustrated in greater detail in the accompanying drawings and described below by way of an example of the invention. In the drawings.

While the following disclosure describes the invention in connection with one embodiment, one should understand that the invention is not limited to this embodiment. Furthermore, one should understand that the drawings are not to scale and that graphic symbols, diagrammatic representations, and fragmentary views, in part, illustrate the embodiment. In certain instances, the disclosure may not include details which are not necessary for an understanding of the present invention, such as conventional details of fabrication and assembly.

DETAILED DESCRIPTION OF THE DRAWINGS

Figure 11:
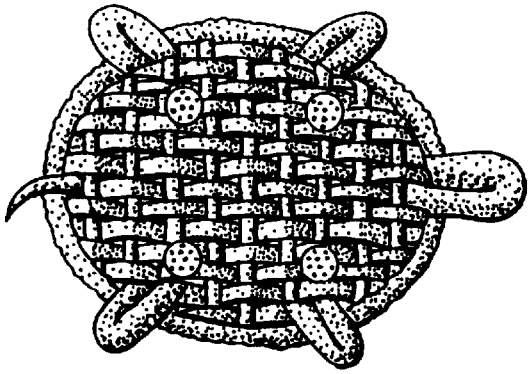
FIG. 11 is a bottom plan view of FIG. 10 showing the support pads used in the present invention.

The dual purpose device that serves as a door closer or stopper and as a wiper, mat, or scraper is manufactured in the shape of a turtle or any other animal or inanimate object using mainly coconut fibre. In the process of manufacture, twisted in coconut fibre rods are in turn cut and shaped to make the shell portion, belly portion, head, legs and tail of a turtle. On the base of the belly, anti-skid rubber pads are pasted with a suitable adhesive (or tied with binding wire) to resist movement and take part of the load (See FIG. 11).

Figure 1:
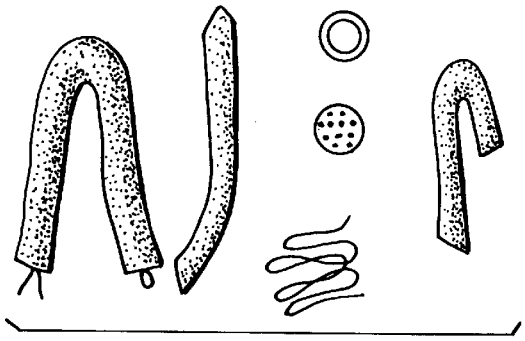
FIG. 1 is an enlarged view of rods and binding wire used in the present invention.
Figure 4:
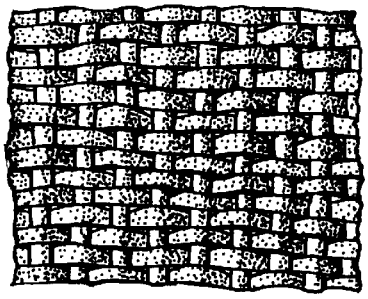
FIG. 4 is a plan view of a completely woven rush mat.
Figure 2:
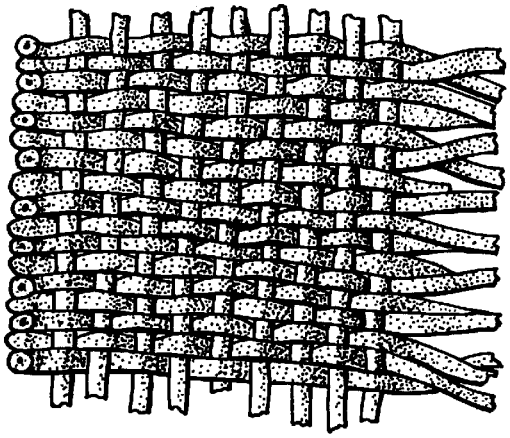
FIGS. 2 and 3 are plan views of partially woven rush mats used to make the present invention.
Figure 5:
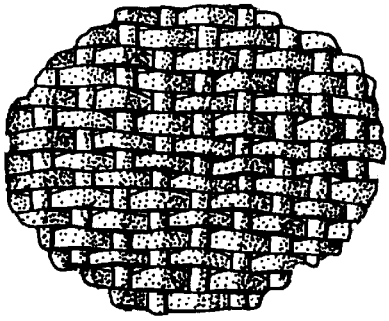
FIG. 5 is a plan view of a mat such as the one shown in FIG. 4 with the sides trimmed to form a rounded shell portion.
Figure 3:
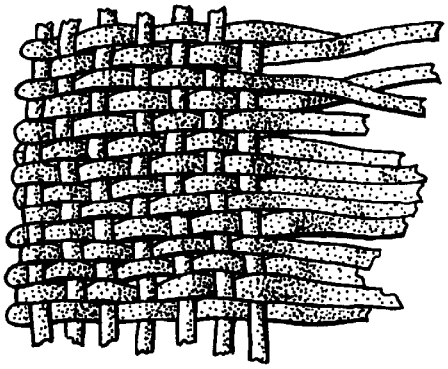
Figure 6:
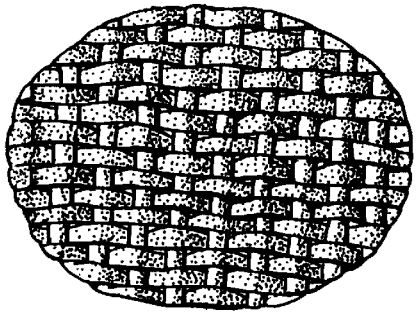
FIG. 6 is a plan view of a mat such as the one shown in FIG. 4 with the sides trimmed to form a rounded belly portion.
Figure 7:
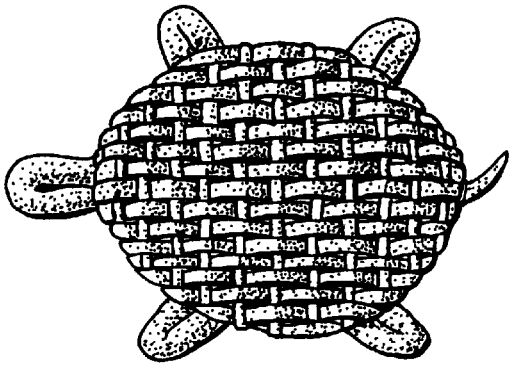
FIG. 7 is a plan view of the shell portion of the present invention.
Figure 10:
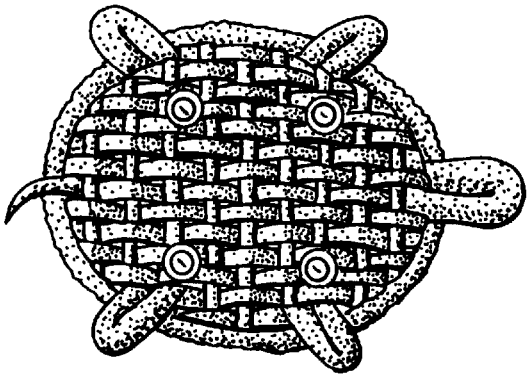
FIG. 10 is a bottom plan view of the present invention.

Initially, different parts are prepared using rods made out of coconut fibre that has been twisted into the shape of a rod. These rods are trimmed and cut to required lengths and shaped to obtain the different required components for assembly. Main items are the shell and the belly portions, and these are woven in a manner similar to that used to weave a cadjan or a rush mat (See FIGS. 2 and 3). FIG. 1 shows the rods for making the head, legs and tail. FIG. 6 shows the shell portion; and FIG. 7 shows the attachments (head, legs and tail) that are tied to the shell portion using the binding wire.

Figure 8:
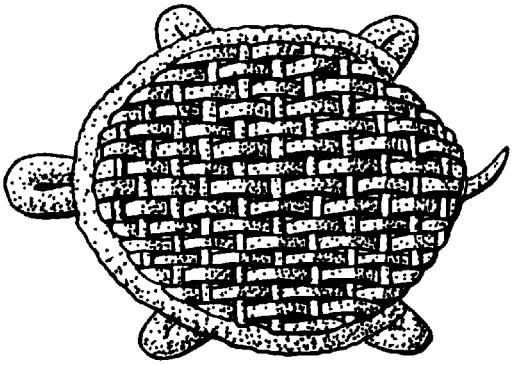
FIG. 8 is a plan view of the shell portion with head, leg and tail attachments.
Figure 9:
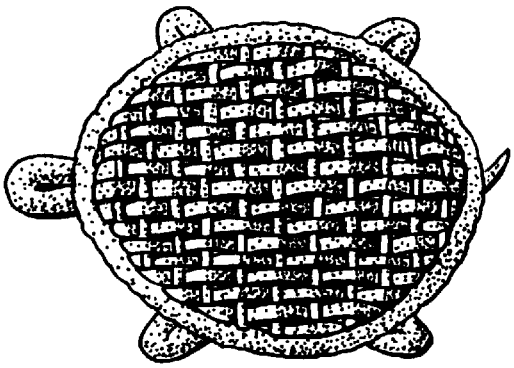
FIG. 9 is a plan view of the shell with edge rods included.

An edge rod is tied to the shell piece along the periphery; and the edge rod is a combination of two or more twisted in fibre rods. (See FIGS. 8 and 9) This assembly thus becomes the top part of the turtle. An assembly of a mat piece formed into a belly portion and the non-skid rubber pads becomes the bottom part of the turtle. Finally the shell and the belly assemblies are combined by tying them together with binding wire followed by the final finishing processes described below. The anti-skid property of this combination wiper and closer is another distinct advantage over the prior art items separately available in the market.

The coconut fibre used to manufacture this product can be dyed any color prior to the manufacturing process to give a cosmetic or matching effect to the finished device. Different components such as the shell and the belly portions, etc., could be made in different colors to obtain an attractive product. Even the size and shape of the end product could be chosen by varying the sizes and shapes of the components.

The rod diameters, weight of the fibre used, and the size of the components determine the strength factor of the end product. A tolerance of ±10% is allowed in these figures for the manufacture of a preferred embodiment; and these figures and the sizes do not in any way limit the scope of the claims given hereunder.

By way of a specific example, a combination mat and closer device was constructed using the following specification:

PRODUCT SPECIFICATIONS

| TYPE | HEAD LENGTH (CM) | HEAD WIDTH (CM) | HEAD ROD DIA. (MM) | LEG LENGTH (CM) | LEG WIDTH (CM) | LEG ROD DIA. (MM) | TAIL ANGLE AV. LENGTH (CM) | TAIL ANGLE TO SHELL (DEG) | TAIL ROD DIA. (MM) |
|---|---|---|---|---|---|---|---|---|---|
| LARGE | 7 | 5 | 28 | 4 | 3.5 | 21 | 3.5 | 45 | 21 |
| SMALL | 6 | 6 | 28 | 3.6 | 3.6 | 21 | 3 | 46 | 21 |

| TYPE | NON SKID PAD ARRG. MAXIMUM DIA. (CM) | NON SKID PAD ARRG. THICKNESS (MM) | NON SKID PAD ARRG. WEIGHT (GRAMS) | OVERALL LENGTH (CM) | OVERALL WIDTH (CM) | OVERALL HEIGHT (CM) | OVERALL WEIGHT (GRAMS) |
|---|---|---|---|---|---|---|---|
| LARGE | 4.5 | 8 | 20 | 40 | 29 | 12 | 770 |
| SMALL | 4.6 | 8 | 20 | 34.5 | 24 | 10 | 680 |

MATERIAL (RODS) SPECIFICATION - TURTLE
FIBRE - UNBLEACHED COCO
TWISTING WIRE - LOCAL GALVANIZED IRON (G1)

| TYPE | WEIGHT OF FIBRE/ ROD (G) | TWISTING WIRE LENGTH (MM) | TWISTING WIRE WEIGHT (GRAMS) | TWISTING WIRE DIAMTR. (MM) | TRIMMED ROD LENGTH (CM) | TRIMMED ROD WEIGHT (GRAMS) | TRIMMED ROD DIAMTR. (MM) | NUMBER OF RODS USED |
|---|---|---|---|---|---|---|---|---|
| LARGE | 33 | 1150 | 18 | 1.6 | 47 | 38 | 21 | 32 |
| | 22 | 750 | 12 | 1.6 | 30 | 22 | 21 | 18 |
| | 35–40 | 880 | 18 | 1.8 | 31 | 34 | 28 | 1 |
| SMALL | 33 | 1150 | 18 | 1.6 | 47 | 38 | 21 | 26 |
| | 22 | 750 | 12 | 1.6 | 30 | 22 | 21 | 13 |
| | 35–38 | 860 | 16 | 1.8 | 30 | 33 | 28 | 1 |

TOLERANCE ±10%

The raw materials other than the coconut fibre used car be changed to alternate suitable products such as aluminum wire or steel wire or any other metallic wire to make the fibre rods, and the binding wire may be substituted with nylon, coir yarn, or jute twine and the rubber pads may be replaced with any other anti-skid plastic or nylon material. The belly component of the turtle may be made by a material such as jute hessin or similar materials.

While the above description and the drawings disclose and illustrate one embodiment, one should understand, of course, that the invention is not limited to this embodiment. Those skilled in the art to which the invention pertains may make other embodiments employing the principles of this invention, particularly upon considering the foregoing teachings. Therefore, by the appended claims, the applicant intends to cover any modifications and other embodiments as incorporate those features which constitute the essential features of this invention.

What is claimed is:

1. A combination door stopper, closer, and mat made out of rods, anti-skid pads and binding wire characterized in that the rods include fibers that provide wiping action, the rods being tied with the binding wire to form a body, and the anti-skid pads lying secured to the body at the bottom to prevent skidding of the body.

2. Method of manufacturing a combination door closer, stopper and mat made out of fibre rods with fibers that provide wiping action, anti-skid rubber pads that prevent skidding and binding wire, said method comprising the steps of:

(a) forming a portion of the combination with fibre rods, (b) cutting fibre rods to predetermined sizes and shaping them to obtain one or more attachments, (c) securing the attachments to the portion with binding wire, (d) securing an edge rod around the portion along the periphery of the portion with binding wire, (e) securing a plurality of non-skid pads to the bottom of the portion.

3. The combination of claim 1 wherein the rods are made of metal or natural fibre.

4. The combination of claim 3 wherein the binding is made with coco yarn and/or jute and/or nylon yarn instead of binding wire.

5. The combination of claim 4 wherein the anti-slip/skid pads are made of a plastic material.

6. The method of claim 2 wherein the binding material may be coir yarn or nylon yarn instead of binding wire.

7. The method of claim 2 wherein the fibre rods are made out of metal.

8. The method of claim 2 wherein the anti-slip/skid pads are made out of a plastic material.

9. The combination of claim 1 wherein the body portion is made out of jute hessin.

10. The method of claim 2 wherein the fibre rods are dyed with one or more colors.

* * * * *